US006082074A

United States Patent [19]

Shaw et al.

[11] Patent Number: 6,082,074

[45] Date of Patent: Jul. 4, 2000

[54] METHOD OF FABRICATING LAYERED DECORATIVE WALL

[76] Inventors: Lee A. Shaw, 2672 Crestview Dr., Newport Beach, Calif. 92663; Ronald D. Shaw, 1401 Outrigger Dr., Corona Del Mar, Calif. 92625

[21] Appl. No.: 09/094,763

[22] Filed: Jun. 15, 1998

Related U.S. Application Data

[63] Continuation-in-part of application No. 09/001,329, Dec. 30, 1997, which is a continuation-in-part of application No. 08/906,286, Aug. 4, 1997, Pat. No. 5,887,399.

[51] Int. Cl.[7] ..... E04B 2/84

[52] U.S. Cl. ..... 52/742.14; 52/741.13; 52/745.09; 52/311.1; 52/315; 52/612; 249/18; 249/33; 249/34; 249/35; 264/34

[58] Field of Search ..... 52/311.1, 311.2, 52/315, 318, 612, 741.13, 741.14, 742.14, 745.09; 264/31, 33, 34; 249/18, 33–35, 16, 20, 47; 256/19

[56] References Cited

U.S. PATENT DOCUMENTS

| | | | |
|---|---|---|---|
| 348,443 | 8/1886 | Anderson . | |
| 745,068 | 11/1903 | Menczarski . | |
| 821,277 | 5/1906 | Bellars | 249/16 |
| 828,031 | 8/1906 | Kemper | 249/16 |
| 830,747 | 9/1906 | Stauffer | 249/16 X |
| 836,369 | 11/1906 | Dexter | 249/20 X |
| 958,194 | 5/1910 | Thomas . | |
| 967,836 | 8/1910 | Rodham | 249/16 X |
| 969,345 | 9/1910 | Adamson | 249/16 |
| 1,397,678 | 11/1921 | De Paoli . | |
| 1,534,353 | 4/1925 | Besser . | |
| 2,021,210 | 11/1935 | Thorn | 249/35 X |
| 2,101,540 | 12/1937 | Gullich . | |
| 2,381,613 | 8/1945 | Mitchell . | |
| 2,493,826 | 1/1950 | Oelfke et al. | 249/35 X |
| 3,874,140 | 4/1975 | Seehusen . | |
| 4,070,849 | 1/1978 | DiGiacomo . | |
| 5,887,399 | 3/1999 | Shaw et al. . | |

*Primary Examiner*—Robert Canfield
*Attorney, Agent, or Firm*—Stetina Brunda Garred & Brucker

[57] ABSTRACT

A method of fabricating a formed wall structure having a plurality of discrete layers. The method includes pouring a first layer of a first concrete mixture into a first vertical form whose depth is equal to that of the first layer; pouring a second layer of a second such mixture on top of the first layer and into a second vertical form whose depth is equal to the depth of the second layer and where at least one of the walls of the second form is not in alignment with an adjacent vertical wall of the first form; and pouring at least one additional layer into a respective at least one additional vertical form situated on top of a next lower vertical form and having a vertical depth equal to the at least one additional layer and where at least one of the interior walls is not in alignment with at least a portion of a vertically adjacent interior wall of the next lower vertical form. The concrete mixtures are permitted to cure sufficiently to retain their respective shapes, and thereafter the forms are removed. This methodology accomplishes replication of naturally occurring walls whose several face layers are not situated in total alignment with each other to thereby achieve enhanced aesthetically appealing wall structures for placement as desired.

2 Claims, 1 Drawing Sheet

Fig. 1
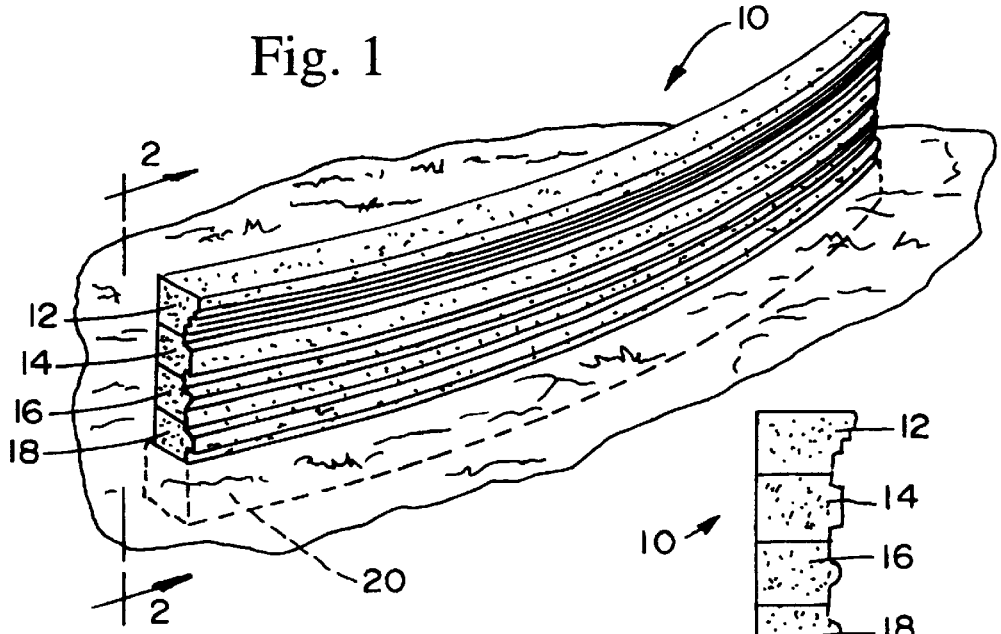
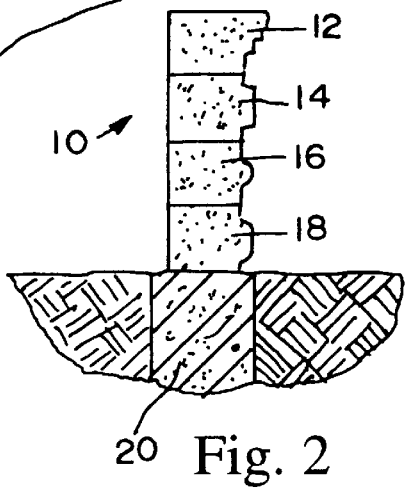
Fig. 2
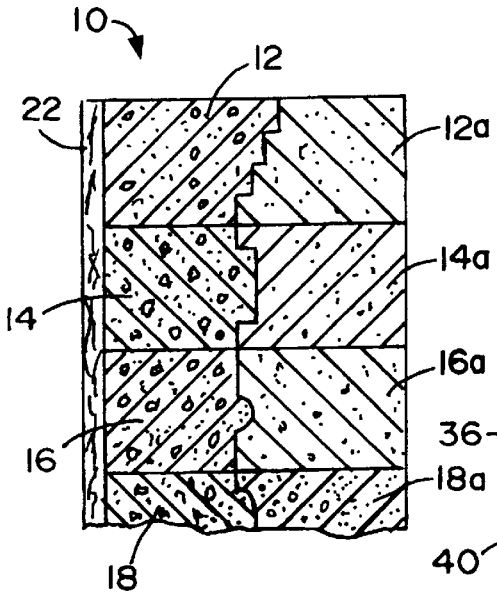
Fig. 3
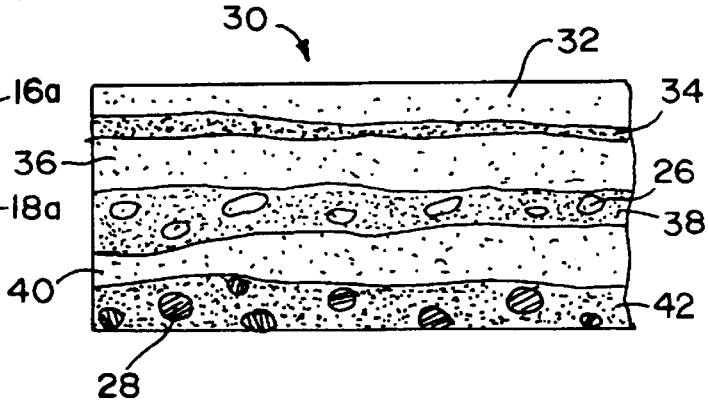
Fig. 4

METHOD OF FABRICATING LAYERED DECORATIVE WALL

CROSS REFERENCE TO RELATED APPLICATION

This application is a continuation-in-part application of U.S. patent application Ser. No. 09/001,329, entitled METHOD OF FABRICATING DECORATIVE WALL filed Dec. 30, 1997, which is a continuation-in-part application of U.S. patent application Ser. No. 08/906,286, filed Aug. 4, 1997, now U.S. Pat. No. 5,887,399.

FIELD OF THE INVENTION

The present invention relates in general to decorative walls such as for landscaping, interior decor, and the like, and in particular to fabrication of a decorative wall having a plurality of discrete layers wherein at least some of the layers protrude outwardly to aesthetically replicate a natural image of a naturally occurring wall structure.

BACKGROUND OF THE INVENTION

Many of the most desirable sights around the world are those formed by events caused over many years by the action of nature. Especially noteworthy are rock and stone wall formations created by centuries of erosion by water, by volcanic actions, or by other natural phenomena that expose a vertical face plane revealing a series of layers that represent respectively different mineral deposits, sedimentary accumulations, fossilized precipitates, and other naturally assembled matter. Of special interest are layered rock formations where some of the layers project outwardly to thereby produce a profiled vertical face. Evidence of the appeal of all of these natural attractions is apparent in the number of tourists who visit such places as the Rocky Mountains, Bryce Canyon, and other similar destinations in the United States every year.

While the pleasure of these attractions is formidable, on-going enjoyment for most people when their respective visitations are over is generally limited to viewing photographs of these naturally layered wall-like structures. Thus, and although such walls are naturally available at only relatively few locations where actual residence generally is not even available, it is believed that a bona fide replication of the appearance of such walls at sites selected by respective viewers is desirous. Accordingly, a primary object of the present invention is to fabricate a formed wall structure whose exteriorly visible vertical plane has a plurality of layers of varying outward protrusions and situated to replicate natural appearance.

Another object of the present invention is to fabricate a formed wall structure with discrete layer separations.

Yet another object of the present invention is to fabricate a formed wall structure wherein the plurality of layers differ from each other in appearance and can include visible shells, rocks, colorant, or other materials.

These and other objects of the present invention will become apparent throughout the description thereof which now follows.

SUMMARY OF THE INVENTION

The present invention is a method of fabricating a formed wall structure comprising a plurality of discrete layers. Each of the layers of the structure comprises concrete, with at least one of such layers preferably additionally comprising a decorative additive, and with each layer having an interface with an adjacent layer to thereby form a plurality of interfaces wherein at least one of the plurality of interfaces can be non-level. Non-limiting examples of decorative additives can be selected from the group consisting of rocks, sea shells, colorants, and mixtures thereof that can be added to the concrete as the concrete is being poured. The exposed surface of the constructed wall can be encompassed with a sealing material after optional wall treatment including water or sand blasting, etching, staining, and/or other finishing activities.

The method for fabricating the formed wall structure as defined above comprises, first of all, pouring a first layer of a first concrete mixture into a first substantially vertical form comprising two generally opposing interior walls. The form has a vertical depth substantially equal to that of the first layer. Second, the method comprises pouring a second layer of a second concrete mixture on top of the first layer and into a second substantially vertical form situated on top of the first vertical form. This second vertical form has a vertical depth substantially equal to the depth of the second layer and comprises two generally opposing interior walls wherein at least a portion of at least one of these interior walls is not in alignment with at least a portion of a generally vertically adjacent interior wall of the first vertical form. Third, the methodology includes pouring at least one additional layer, and preferably a plurality thereof, of at least one additional concrete mixture into a respective at least one additional substantially vertical form situated on top of a next lower vertical form. This at least one additional vertical form has a vertical depth substantially equal to that of the at least one additional layer and comprises two generally opposing interior walls wherein at least a portion of at least one of the interior walls is not in alignment with at least a portion of a generally vertically adjacent interior wall of the next lower vertical form. The concrete mixtures of the respective layers are permitted to cure sufficiently to retain their respective shapes, and thereafter the forms are removed. Preferably, at least one of the two opposing interior walls of at least one of the vertical forms is non-planar to thereby form projections and indentations in one or more respective individual layers.

The interfaces between respective layers can be cold joints caused by adequate curing between layer pouring as well as by inclusion of a joint forming material, or the methodology can provide for a substantially continuous pouring activity such that cold joint formation at interfaces does not occur. As is apparent, the present methodology for fabricating a wall structure accomplishes replication of naturally occurring walls whose several face layers are not situated in total alignment with each other. However, certain adjacent layers can be in alignment with each other as desired, meaning of course that the present methodology can include appropriate form placement where alignment will occur with respect to one or more adjacent layers as could occur in nature. By providing a non-flat wall face, the present invention achieves enhanced aesthetically appealing wall structures that can be provided for placement and enjoyment at critical sites for architectural as well as artistic functionality.

BRIEF DESCRIPTION OF THE DRAWINGS

An illustrative and presently preferred embodiment of the invention is shown in the accompanying drawings in which:

FIG. 1 is a perspective view of a decorative wall structure having a plurality of layers;

FIG. 2 is a side elevation view of the wall structure of FIG. 1 along line 2—2 thereof;

FIG. 3 is a side cross section view of a portion of a form assembly during wall construction; and FIG. 4 is a front elevation view of a second embodiment of a decorative wall structure having a plurality of layers.

DETAILED DESCRIPTION OF THE PREFERRED EMBODIMENTS

Referring to FIGS. 1–3, a wall structure 10 having four layers 12, 14, 16, 18 is shown. The wall structure 10 is positioned on a conventional footing 20 as known in the art, and each layer 12, 14, 16, 18 is constructed individually by use of individual forms 12*a*, 14*a*, 16*a*, 18*a* preferably fabricated of conventional open or closed cell foam. In the embodiments here shown, a vertically disposed wooden back wall form 22 is situated along the rear face 24 of the wall structure 10 to service all of the layers 12, 14, 16, 18, while the front faces of each layer 12, 14, 16, 18 are formed by the individual foam forms 12*a*, 14*a*, 16*a*, 18*a*. Alternatively, an individual foam form for each layer and encompassing the entire circumference of that layer can be employed, thereby eliminating the back wall form 22.

Construction of the wall structure 10 commences by pouring a first quantity of a first concrete mixture within the confines of the form 12*a* and the opposing relative portion of the back wall form 22 to thereby construct the first layer 12. The concrete mixture preferably has a decorative additive that can be selected from the group consisting of rocks 26 (FIG. 4), sea shells 28 (FIG. 4), colorant, and mixtures thereof which is added either before or during the pouring procedure. Either immediately before curing of the layer 12, or later after the layer 12 has cured sufficiently to form a cold joint naturally or after a cold joint forming material is applied, the second layer 14 is poured in the same manner but within the confines of the second foam form 14*a*, which is placed atop the first form 12, and the opposing portion of the back wall form 22. In the same manner, layers 16 and 18 (as well as additional layers as desired) are constructed using forms 16*a* and 18*a*, all as shown in FIGS. 1–3. While the interfaces between layers in FIGS. 1–3 are generally level, the wall structure 30 shown in FIG. 4 illustrates a second preferred embodiment wherein the interfaces between layers 32, 34, 36, 38, 40, 42 are generally non-level. Either style, or a combination of the two, can be built as desired for a particular application.

The foam forms 12*a*, 14*a*, 16*a*, 18*a* of FIGS. 1–3 are provided with different interior wall shapes such that each layer 12, 14, 16, 18 of the wall structure 10 is provided with a different sculpted face surface. It is preferred that, as shown, at least a portion of at least one of the interior walls of one form is not in alignment with at least a portion of a generally vertically adjacent interior wall of the next form. As desired, the forms 12, 14, 16, 18 can be of a size and shape in relation to one another such that the face(s) of one or more entire layers is out of alignment with the face(s) of the next adjacent layer(s) of a finished wall structure.

After the concrete mixtures have cured sufficiently to retain the sculpted wall shapes, the foam forms 12*a*, 14*a*, 16*a*, 18*a* and the back wall form 22 are removed. Depending upon the appearance desired and/or required, the wall structure 10 then can be sand blasted, water blasted, etched, sponged, chipped, sealed, stained, tinted with a dust-on colorant, and/or combination treatments thereof in accord with a final appearance goal.

As is apparent, the present invention provides a readily fabricated wall structure whose exteriorly visible face layers replicate the appearance of a naturally formed wall. While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A method of fabricating a wall structure having a plurality of layers, the method comprising:

a) pouring a first layer of a first concrete mixture into a first substantially vertical form comprising two generally opposing interior walls and having a vertical depth substantially equal to said first layer;

b) pouring a second layer of a second concrete mixture on top of the first layer and into a second substantially vertical form situated on top of the first vertical form and having a vertical depth substantially equal to said second layer and comprising two generally opposing interior walls wherein at least a portion of at least one of said walls is not in alignment with at least a portion of a generally vertically adjacent interior wall of the first vertical form;

c) sequentially pouring at least one additional layer of at least one additional concrete mixture into a respective at least one additional substantially vertical form situated on top of a next lower vertical form and having a vertical depth substantially equal to said at least one additional layer and comprising two generally opposing interior walls wherein at least a portion of at least one of said walls is not in alignment with at least a portion of a generally vertically adjacent interior wall of the next lower vertical form;

d) placing a joint forming material on a top surface of at least one of the layers;

e) permitting the concrete mixtures of the respective layers to cure sufficiently to retain respective shapes; and f) removing the forms.

2. A method of fabricating a wall structure having a plurality of layers, the method comprising:

a) pouring a first layer of a first concrete mixture into a first substantially vertical form comprising two generally opposing interior walls and having a vertical depth substantially equal to said first layer;

b) pouring a second layer of a second concrete mixture on top of the first layer and into a second substantially vertical form situated on top of the first vertical form and having a vertical depth substantially equal to said second layer and comprising two generally opposing interior walls wherein at least a portion of at least one of said walls is not in alignment with at least a portion of a generally vertically adjacent interior wall of the first vertical form;

c) sequentially pouring at least one additional layer of at least one additional concrete mixture into a respective at least one additional substantially vertical form situated on top of a next lower vertical form and having a vertical depth substantially equal to said at least one additional layer and comprising two generally opposing interior walls wherein at least a portion of at least one of said walls is not in alignment with at least a portion of a generally vertically adjacent interior wall of the next lower vertical form;

d) permitting the concrete mixtures of the respective layers to cure sufficiently to retain respective shapes;

e) permitting a top surface of at least one layer to cure sufficiently to form a cold point with a next above layer; and f) removing the forms.

* * * * *